US005471191A

United States Patent [19]

Narita

[11] Patent Number: 5,471,191

[45] Date of Patent: Nov. 28, 1995

[54] GOLF SCORE DISPLAY DEVICE

[76] Inventor: Fujiaki Narita, 23-5, Mukonoso 5-chome, Amagasaki-shi, Hyogo 661, Japan

[21] Appl. No.: 152,238

[22] Filed: Nov. 16, 1993

[30] Foreign Application Priority Data

Nov. 16, 1992 [JP] Japan ..... 4-331156

[51] Int. Cl.[6] ..... G08B 23/00

[52] U.S. Cl. ..... 340/323 R; 273/162 A; 273/DIG. 26; 364/411

[58] Field of Search ..... 340/323 R; 364/410, 364/411; 377/5; 235/1 B; 273/162 A, DIG. 26; 116/222

[56] References Cited

U.S. PATENT DOCUMENTS

| | | | |
|---|---|---|---|
| 4,142,236 | 2/1979 | Martz et al. | 273/162 A |
| 4,367,526 | 1/1983 | McGeary et al. | 340/323 R |
| 4,864,592 | 9/1989 | Lee | 364/411 |
| 4,974,161 | 11/1990 | Cullen | 273/DIG. 26 |
| 5,377,982 | 1/1995 | Villarreal, Jr. | 273/DIG. 26 |
| 5,384,561 | 1/1995 | Smith | 340/323 R |

FOREIGN PATENT DOCUMENTS

| | | | |
|---|---|---|---|
| 2243302 | 10/1991 | United Kingdom | 364/410 |

*Primary Examiner*—Brent Swarthout
*Attorney, Agent, or Firm*—Klima & Hopkins

[57] ABSTRACT

A counter switch is depressed every stroke so that such stroke number is added up and displayed on a display. After completion of a first hole, a hole switch is depressed to be switched to a counter for a second hole, so that the count value for the first hole is fixed and a stroke number of the second hole is counted by the counter for the second hole and displayed on a respective display. The total stroke number of the out course is added up in a counter therefor and displayed on a respective display, and the total stroke number from the first is added up in a respective counter to be displayed on a respective display. When nine holes are completed and a next hole switch is depressed, the counter is switched to that for adding up the total stroke number of the in course, so that the stroke numbers of the respective holes are added up by respective counters and displayed on respective displays.

9 Claims, 7 Drawing Sheets

GOLF SCORE DISPLAY DEVICE

BACKGROUND OF THE INVENTION

1. Field of the Invention

The present invention relates to a golf score display device for a golf player for inputting his stroke number every stroke on the green and displaying the same.

2. Description of the Background Art

In general, a golf player records his stroke number on a prescribed paper every hole, to calculate the total every round. However, he may forget his stroke number, and it takes time to calculate the total.

FIG. 7 shows a conventional mechanical counter 60 for calculating the stroke number every hole. The golf player wears this counter 60 on the wrist and pushes its button every stroke, so that the counter 60 displays the stroke number. This mechanical counter 60 is reset every hole. No total of the round is displayed.

SUMMARY OF THE INVENTION

An object of the present invention is to release a golf player from a trouble of recording his stroke number on a paper during the game, and to enable display of the stroke number every hole as well as the total stroke number every round.

A golf score display device according to the present invention comprises a counter switch which is depressed every stroke to input the stroke number, a hole switch which is depressed every hole, a counter part connected with the counter switch, having first counters corresponding to respective holes of one round, second counters corresponding to first and second halves of the round and a third counter corresponding to the whole round, first switching means for connecting the counter switch to any one of the first counters while successively switching this connection by outputs of the hole switch, first frequency divider means which is set to receive the outputs of the hole switch and generate an output at the half hole number of the round, second switching means for connecting the counter switch to either one of the second counters while alternately switching this connection by outputs of the first frequency divider means, and a display part which is provided with digital display elements having display switching functions for the respective counters.

According to a preferred mode of the present invention, the golf score display device further comprises second frequency divider means which is set to receive the outputs of the hole switch and generate an output at the hole number of one round, a data memory part having a plurality of data memories for storing count values of the counters provided in the counter part so that the first stage data memory stores the count values of the counters provided in the counter part and the remaining data memories store contents of those in previous stages, a data switch for switching the display content of the display part, and third switching means for connecting the display part to any one of the data memories provided in the data memory part while successively switching this connection by outputs of the data switch.

According to another preferable mode of the present invention, the golf score display device further comprises a data memory serial conversion part which is connected to the first stage data memory of the data memory part for converting the content of this data memory to serial data by an external trigger signal and outputting the same.

According to still another preferable mode of the present invention, the display part is formed by a liquid crystal display element, while the counter part, the respective switching means, the respective frequency divider means, the data memory part and the data memory serial conversion part are integrated into a circuit, so that the overall display device is packaged in the form of a card.

According to a further preferable mode of the present invention, the counter part, the respective switching means, the respective frequency divider means and the data memory part are formed by a microcomputer system, so that functions of the respective parts are implemented by software.

According to the present invention, it is possible to display the stroke number on a display corresponding to each stroke while displaying total stroke numbers of out and in courses (front and back nines) on respective displays and displaying the total stroke number of one round on a corresponding display, whereby the golf player can devote himself to his play with no trouble.

When a data memory is provided to store past data, the golf player can observe his condition by reading his past data at any time.

When the inventive display device is devised to be capable of outputting data to the exterior, it is possible to process data of a number of golf players, thereby contributing to calculation of data in a golf competition or the like.

When the inventive display device is entirely packaged in the form of a card, the golf player can conveniently carry the card in his pocket.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
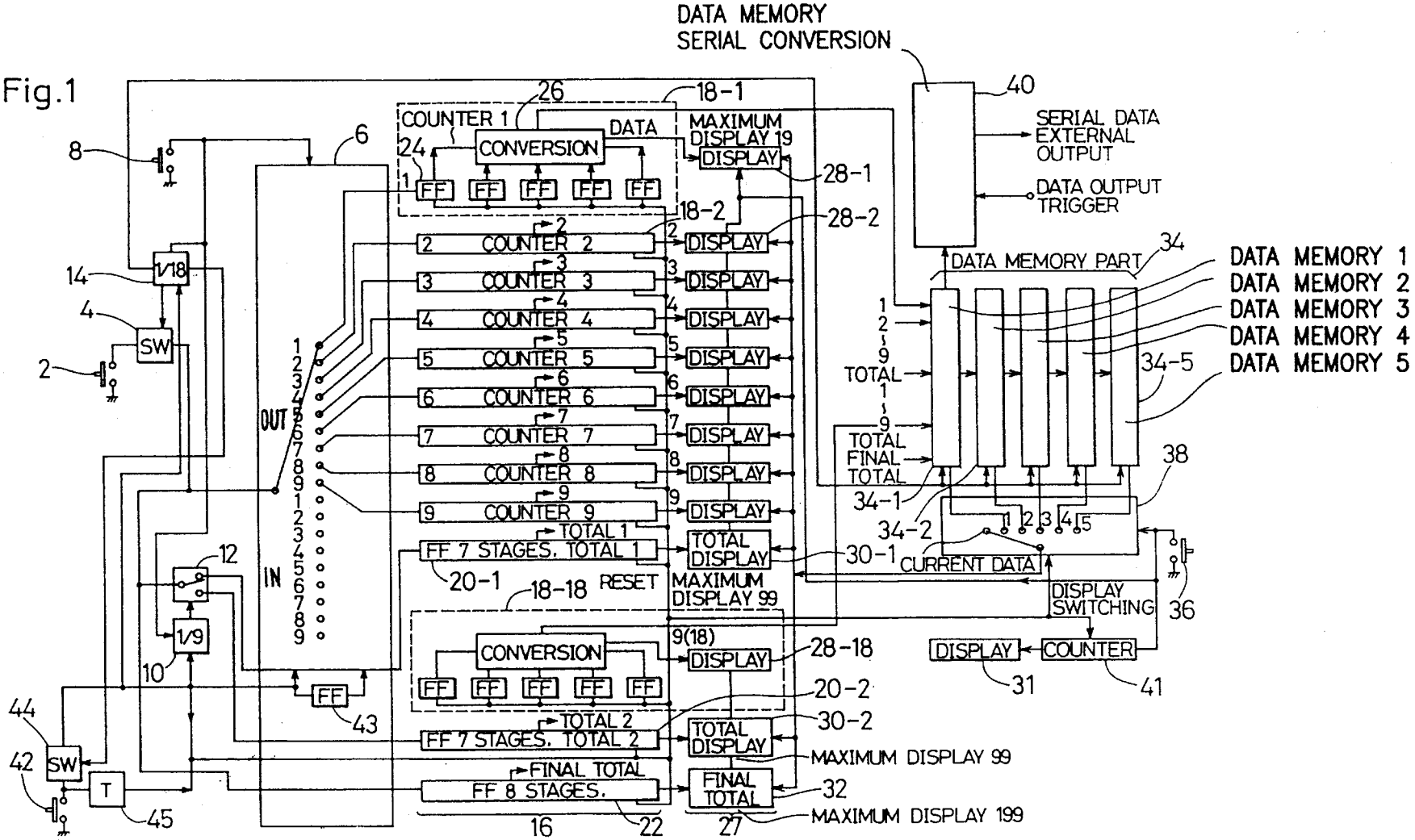
FIG. 1 is a block diagram showing an embodiment of the present invention.

FIG. 1 is a block diagram showing an embodiment of the present invention.

Referring to FIG. 1, a pushbutton counter switch 2, which is pushed every stroke to input every stroke number, is connected to demultiplexers 6 and 12 and a counter 22 for indicating the total stroke number of one round through a counter input switching circuit 4. The counter input switching circuit 4 is turned off by an output of a frequency divider 14. A pushbutton hole switch 8 is depressed every hole, so that its output is transmitted to the demultiplexer 6 and frequency dividers 10 and 14.

A counter part 16 is provided with counters 18-1 to 18—18 corresponding to respective holes of one round, counters 20-1 and 20-2 corresponding to first and second halves of the round respectively, and the counter 22 corresponding to the overall round. Each of the counters 18-1 to 18—18, which is formed by five stages of flip-flops 24, can count numbers up to 32, while the upper limit of such counting may be 19 since each counter is adapted to count only the stroke number in one hole. On the other hand, each of the counters 20-1 and 20-2, which is formed by seven stages of flip-flops 24, can count numbers up to 128, while the upper limit of such counting may be 99 since the counter is adapted to count only the stroke number in a half round. Further, the counter 22, which is formed by eight stages of flip-flops 24, can count numbers up to 256, while the upper limit of such counting may be 199 since the counter 22 is adapted to count only the stroke number in one round. Each counter is provided with a conversion circuit (7-segment decoder) 26 which converts an output of each flip-flop 24 so that the same can be displayed in a 7-segment numeral of a display element. The demultiplexer 6 is adapted to connect an input of the counter switch 2 to any one of the counters 18-1 to 18—18 through the counter input switching circuit 4. This demultiplexer 6 successively switches the connection between the counter input switching circuit 4 and the counters 18-1 to 18—18 through outputs of the hole switch 8. When the connection is switched to the final contact, the demultiplexer 6 is returned to the first contact by a reset signal received from a reset switch 42.

The hole switch 8 is also connected to the frequency dividers 10 and 14. The frequency divider 10 frequency-divides an output of the hole switch 8 into nine, and generates an output signal when the hole switch 8 is depressed nine times. On the other hand, the frequency divider 14 frequency-divides the output of the hole switch 8 into 18, and generates an output signal when the hole switch 8 is depressed 18 times. Namely, the frequency dividers 10 and 14 are adapted to indicate completion of the first and second halves of one round respectively. The output signal of the frequency divider 14 is inputted in a switching circuit 44, which is turned on upon completion of the round so that the reset switch 42 operates to generate a reset signal. When the reset switch 42 is kept in an ON state, a timer 45 is turned on upon a lapse of five seconds to generate a reset signal, to entirely return the device to a starting state even in an intermediate stage of the game. The output signal from the frequency divider 10 is inputted in the demultiplexer 12, which is switching means for connecting the counter input switching circuit 4 being connected with the counter switch 2 to any one of the counters 20-1 and 20-2 provided in the counter part 16 for counting the total stroke numbers in the out and in courses. When the frequency divider 10 is in a reset state, the demultiplexer 12 connects the counter input switching circuit 4 to the counter 20-1, while connecting the same to the counter 20-2 upon detection of a fact that the hole switch 8 is depressed nine times.

In the counter part 16, the counters 18-1 to 18—18 count stroke numbers in the respective holes, the counter 20-1 counts the total stroke number in the first to ninth holes of the out course (front nine), the counter 20-2 counts the total stroke number in the first to ninth holes in the in course (back nine), and the counter 22 counts the total number in all holes of the out and in courses of the round. The counters 18-1 to 18—18 are connected with displays 28-1 to 28-18 respectively, the counters 20-1 and 20-2 are connected with displays 30-1 and 30-2 respectively, and the counter 22 is connected with a display 32. These displays 28-1 to 28-18, 30-1 and 30-2, and 32 are formed by 7-segment digital display elements of liquid crystal elements which can display numerals from 0 to nine. Each of the displays 28-1 to 28-18 and 30-1 and 30-2 includes a two-digit 7-segment display element, which can display numerals from zero to 99. On the other hand, the display 32 includes a three-digit 7-segment digital display element, which can display numerals from zero to 199. Each display has a switching function capable of switching its display to that of data of a data memory part 34 by an output signal of a data switch 36, in addition to display of the counter output.

The data memory part 34 is provided with five data memories 34-1 to 34-5. The first stage data memory 34-1 is connected with each counter of the counter part 16, to incorporate and store the output of each counter by an output signal which is generated from the frequency divider 14 upon completion of one round. Further, each of the remaining data memories 34-2 to 34-5 stores the content of that in a preceding stage. In other words, the data memory 34-1 stores the respective counter values every round as data upon completion of the round, and the storage contents are successively transferred so that data having been stored in the data memory 34-1 are stored in the next stage data memory 34-2 and so on, and the storage content of the final stage data memory 34-5 is erased.

The data switch 36 is a pushbutton switch, whose output is employed for switching the content on the display part 27 and supplied to a demultiplexer 38. The demultiplexer 38, which is adapted to change whether or not the display part 27 is connected to any one of the data memories, is switched from a contact of current data which is connected to no data memory, to the first stage data memory 34-1, then the second stage data memory 34-2 and so on, and again returned to the contact of the current data from the final stage data memory 34-5. When the demultiplexer 38 is switched to the contact of the current data, the display content of the display part 27 is so switched as to display the outputs of the counters provided in the counter part 16.

A counter 41 is adapted to count the number of depression of the data switch 36 up to 5, and then returned to zero to again count the number. A display 31 displays count values of the counter 41 as numerical values of 0 to 5. The numerical value "0" (it is possible to display no zero) indicates that the display part 27 displays current data and "1" indicates that the display part 27 displays data of the last time, while "2", "3", "4" and "5" indicate that the display part 27 displays data of the last time but one, the last time but two, the last time but three and the last time but four respectively. The demultiplexer 38 is reset to the position of the current data by a reset signal, and the counter 41 is reset to "0".

A golf game is generally started from the out course to enter the in course halfway. However, the golf game may be started from the in course as the case may be. In order to cope with such a case, the inventive display device is devised as follows: While the demultiplexer 6 starts its operation by a reset signal from the first hole of the out course, a flip-flop 43 is inverted when the reset signal is generated twice, so that a counter input is started from the first hole of the in course. The out or in course is selected in starting of the golf game, to start the operation. "0" for the first hole of the out or in course may flicker when the reset switch 42 is depressed, to enable judgement of the course from which the game is started. A start position of the demultiplexer 6, which is changed every time the reset switch 42 is depressed, remains unchanged once the counter switch 2 is depressed to start the game.

A data memory serial conversion part 40 is connected to an output of the first stage data memory 34-1, in order to convert the content of this data memory 34-1 to serial data by an external trigger signal and output the same. The data outputted from the data memory serial conversion part 40 to the exterior are fed to an external unit such as a personal computer, and processed in the external unit for creating a table or to be printed out.

Figure 2:
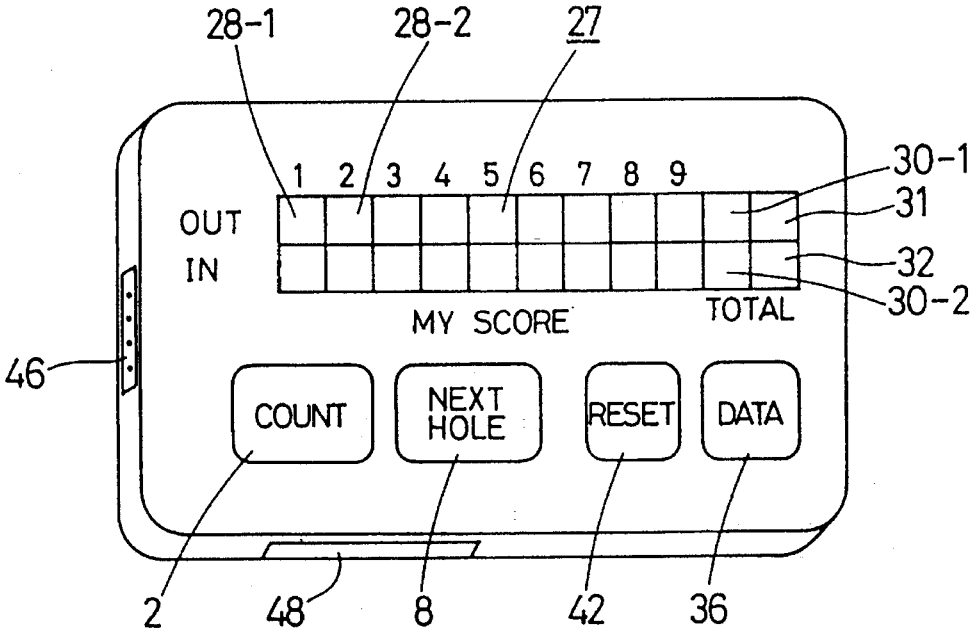
FIG. 2 is a perspective view showing the appearance of the embodiment shown in FIG. 1.

As shown in FIG. 2, the respective switching means 6, 12 and 38, the respective frequency dividers 10 and 14, the counter part 16, the data memory part 34 and the data memory serial conversion part 40 are integrated into a circuit and entirely packaged in the form of a card with the display part 27, the switches 2, 8, 42 and 36, an external data output terminal 46 for connecting the data memory serial conversion part 40 with an external apparatus, a battery mounting part 48 for mounting a battery and the like.

The operation of this embodiment is now described.

In starting of the game, the frequency divider 14 is at 1/18 and the switching circuit 44 is in an ON state. When the reset switch 42 is depressed before starting of the game, therefore, the demultiplexer 6 is connected to the contact of the counter 18-1 for the first hole of the out course, the frequency divider 10 is reset so that the demultiplexer 12 is connected to the contact of the counter 20-1, all counters of the counter part 16 are reset to zero, and the frequency divider 14 is reset so that the counter input switch 4 is turned on. The switching circuit 44 is turned off when the frequency divider 14 advances one, so that the display device is not reset halfway even if the reset switch 42 is erroneously depressed. In order to reset the display device for terminating the game in an intermediate stage or the like, the reset switch 42 is continuously depressed so that the timer 45 acts to generate a reset signal upon continuous depression in excess of five seconds, for example, to return all to the first mode.

When the game is started, the count switch 2 is depressed every stroke so that the flip-flops 24 of the counter 18-1 count numbers in the binary system since the demultiplexer 6 is connected to the contact of the counter 18-1 for the first hole of the out course. Outputs of the flip-flops 24 are converted to segment data by the 7-segment decoder 26, so that the display 281 displays the count value. The stroke number is added up every time the counter switch 2 is depressed, to be displayed on the display 28-1.

After completion of the first hole, the hole switch 8 is depressed for the next hole, whereby the contact of the demultiplexer 6 is switched to that of the counter 18-2 for the second hole of the out course and the count value for the first hole is fixed. The counter switch 2 is depressed every stroke, so that the stroke number in the second hole is counted by the counter 18-2 and displayed on the display 28-2. Since the demultiplexer 12 is connected to the total counter 20-1 for the out course, the counter 20-1 adds up the total stroke number in the out course so that the same is displayed on the display 30-1, while the total stroke number from the first is added up in the counter 22 to be displayed on the display 32.

When the ninth hole of the out course is completed and the game enters the in course so that the next hole switch 8 is depressed, the frequency divider 10 generates an output signal so that the demultiplexer 12 is switched to the contact of the counter 20-2 for adding up the total of the in course. The count switch 2 is depressed every stroke in the first hole of the in course, so that the counter corresponding to this hole adds up the stroke number so that the result is displayed on the corresponding display. Further, the in course total counter 28-2 adds up the total stroke number of the in course, so that the result is displayed on the display 30-2. The counter 22 for obtaining the final total adds up the total stroke number from the first in this round, to continuously display the result on the display 32.

After 18 holes are entirely completed, the hole switch 8 is depressed so that the frequency divider 14 turns off the counter input switch 4 so that the same is not driven even if the counter switch 2 is erroneously depressed, and fixes the score. An output of the frequency divider 14 is outputted to the data memory part 34, which in turn incorporates and stores data of all counters provided in the counter part 16 in the data memory 34-1 while successively transmitting data so that data which have been stored in the data memory 34-1 are stored in the next data memory 34-2, those having been stored in the data memory 34-2 are stored in the next data memory 34-3 and so on, and erases data in the final data memory 30-5. Thereafter the reset switch 42 is depressed to reset all counters of the counter part 16 to zero, while the demultiplexers 6 and 12 are also reset and returned to the initial states.

The data memories 34-1 to 34-5 store scores successively from a new one. In order to display the as-stored scores on the display part 27, the data switch 36 is depressed. When the data switch 36 is depressed once, the display on the display part 27 is switched to the data stored in the data memory 34-1, while the contact of the demultiplexer 38 is switched to the data memory 34-1 so that the display part 27 displays the data stored therein. When the data switch 36 is depressed again, the demultiplexer 38 is switched to the contact of the data memory 34-2, so that the display part 27 displays the data stored therein. The data displayed on the display part 27 are switched from those in the data memory 34-1 to those in the data memory 34-5 every time the data switch 36 is depressed, and the demultiplexer 38 is switched to a contact for current data while the display part 27 is switched to the count values of the counter part 16 next to the data memory 34-5.

The data (those for a precedently completed round) stored in the data memory 34-1 can be outputted to the exterior through the data memory serial conversion part 40. The output terminal 46 is connected to a personal computer or the like, and a trigger signal is supplied to the data memory serial conversion part 40, thereby outputting the data to the exterior. Thus, it is possible to dispose or print out the data in the external unit.

Figure 3:
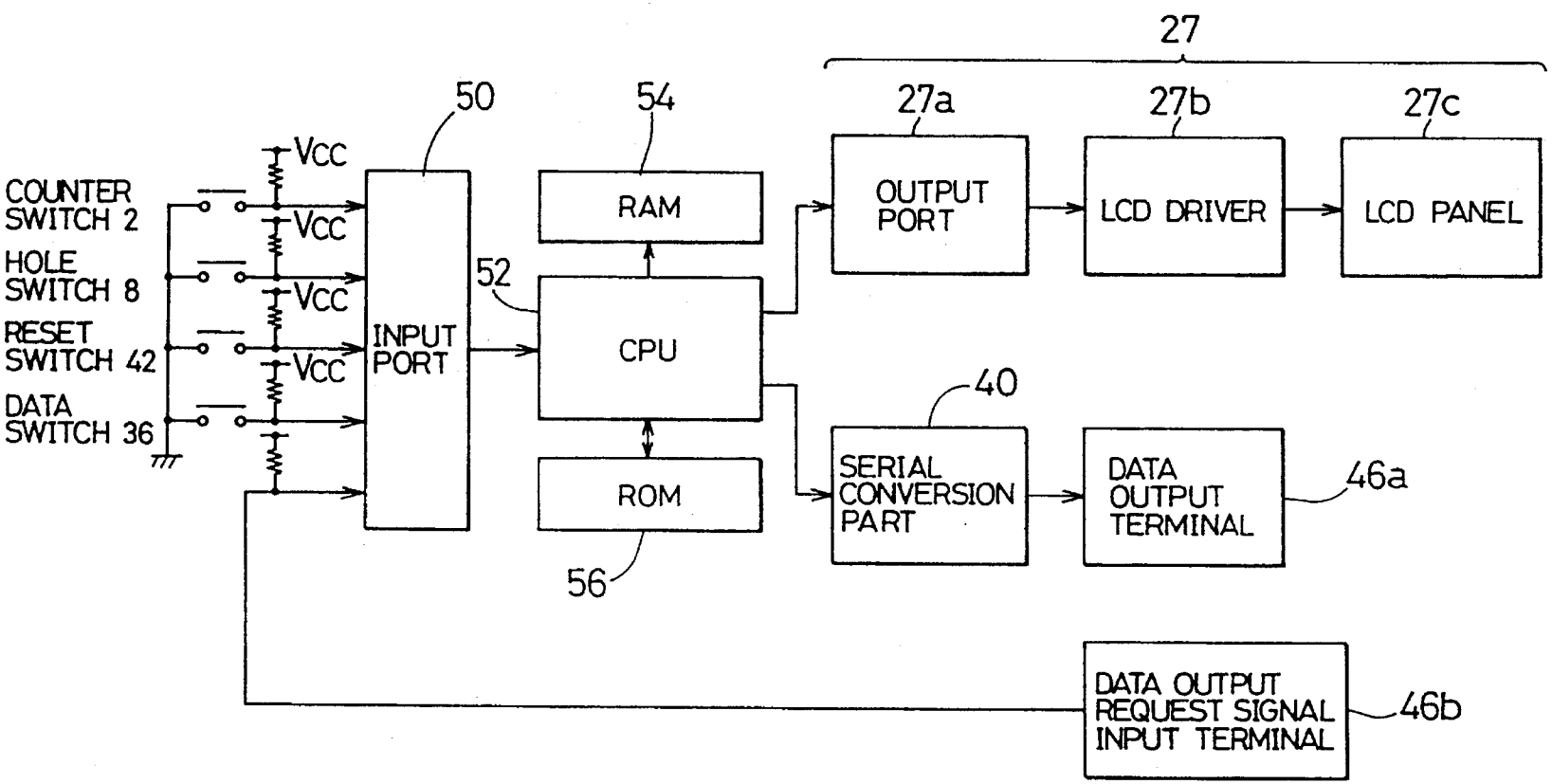
FIG. 3 is a block diagram showing another embodiment for implementing the present invention in a microcomputer system.

The embodiment shown in FIG. 1 can be also implemented by a microcomputer system. FIG. 3 shows such an embodiment. A counter switch 2, a hole switch 8, a reset switch 42 and a data switch 36 are connected to a CPU 52 through an input port 50. The CPU 52 is also connected with a RAM 54 forming a counter part 16 and a data memory part 34 and a ROM 56 storing operation programs. The CPU 52, the RAM 54 and the ROM 56 implement functions of the first, second and third switching means 6, 12 and 38, the first and second frequency dividers 10 and 14, the switching circuits 4 and 44 and the timer 45 shown in FIG. 1. A display part 27 is formed by an LCD driver **27*b* which is connected to the CPU 52 through an output port 27*a* and an LCD panel 27*c* which is driven by the LCD driver 27*b***.

In order to output data to the exterior, a data output terminal **46*a* is connected to the CPU 52 through a data memory serial conversion part 40. The data output terminal 46 shown in FIG. 2 also includes a data output request signal input terminal 46***b*, which receives a data output trigger signal so that this signal is incorporated in the CPU 52 through the input port 50 to start data output.

While the operation of the microcomputer system shown in FIG. 3 implementing the present invention in a software manner is identical to that of the embodiment shown in FIG. 1, this operation is schematically illustrated with reference to FIGS. 4 to 6.

Figure 4:
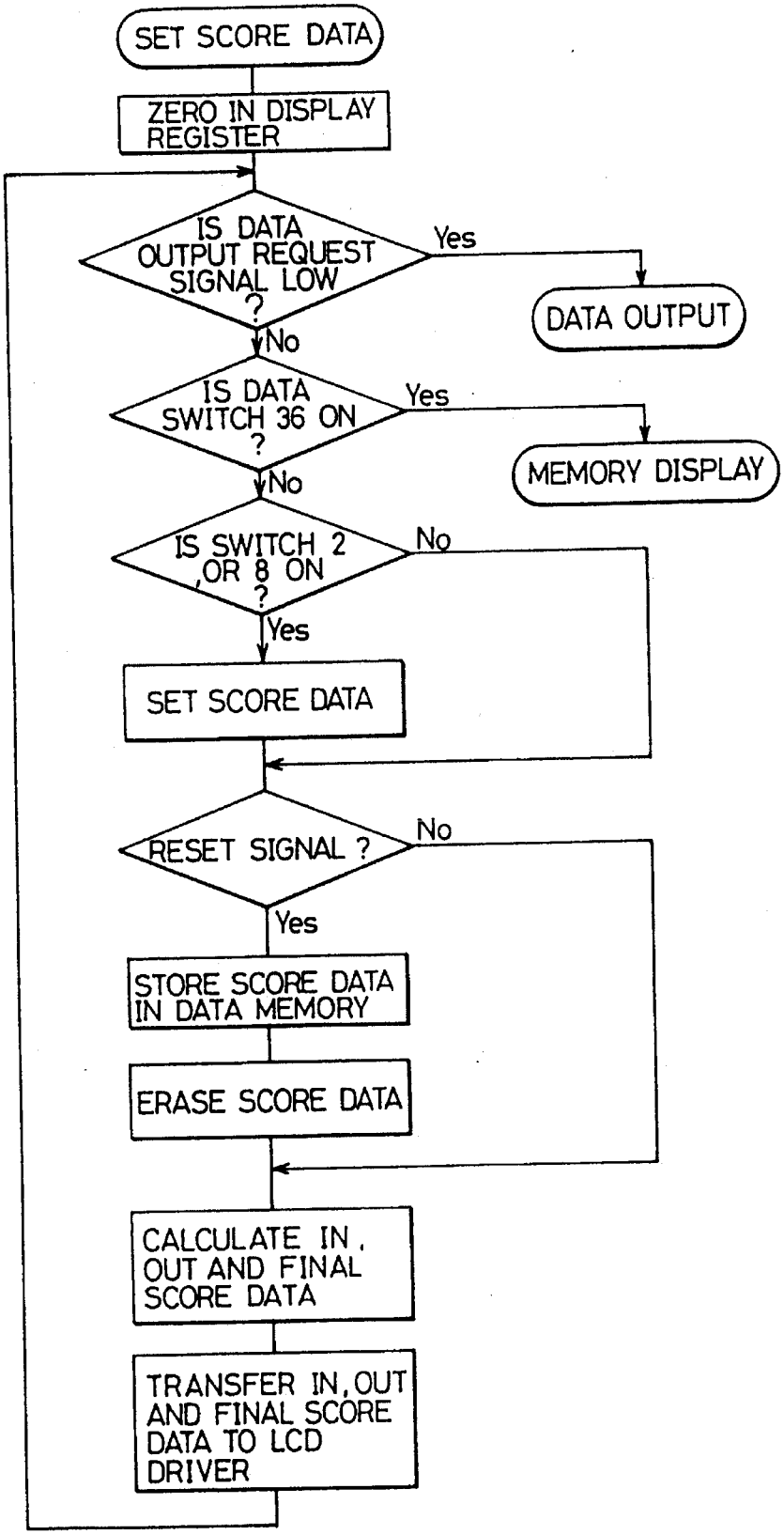
FIG. 4 is a flow chart schematically showing a score data setting operation in the embodiment shown in FIG. 3.

FIG. 4 is a flow chart showing an operation for setting score data (data during the game) on the counter part 16. "0" is set in a display data register corresponding to a counter 41 for a display 31. When the counter switch 2 or the hole switch 8 is depressed in such a state that there is no data output request signal (high level) and the data switch 36 is not turned on, score data are set in a counter for a prescribed hole provided in the counter part 16. When no reset signal is generated from a reset switch 42, the total score data of the in course, the out course and the overall round are calculated and transferred to the LCD driver 27*b*, to be displayed. This operation is repeated every time the counter switch 2 or the hole switch 8 is depressed. When 18 holes are entirely completed, the reset switch 42 is depressed to generate a reset signal, whereby the score data of the counter part 16 are stored in the data memory part 34 as memory data, and the score data are erased from the counter part 16.

Figure 5:
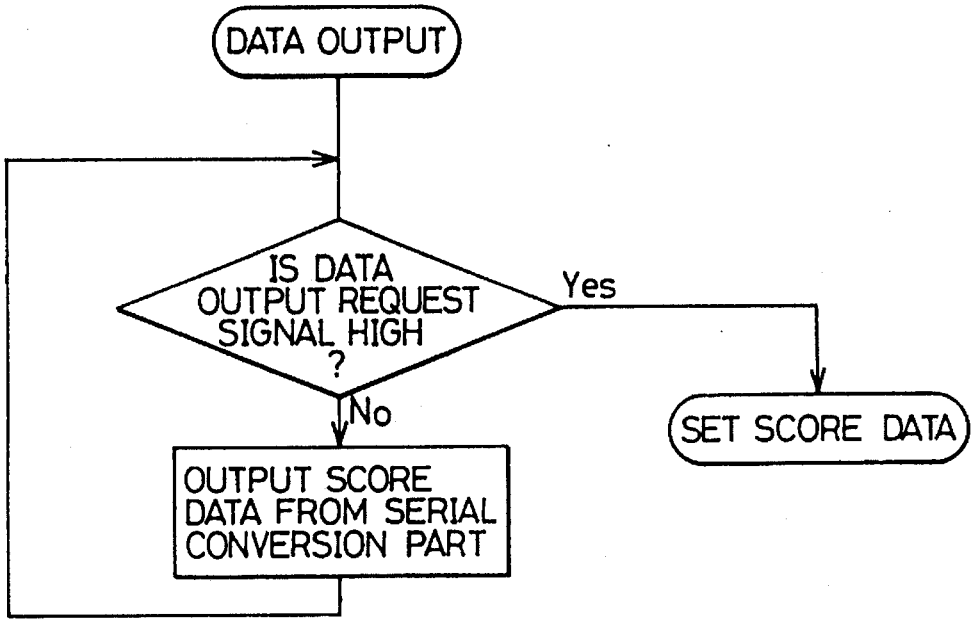
FIG. 5 is a flow chart showing a data output operation in the embodiment shown in FIG. 3.
Figure 6:
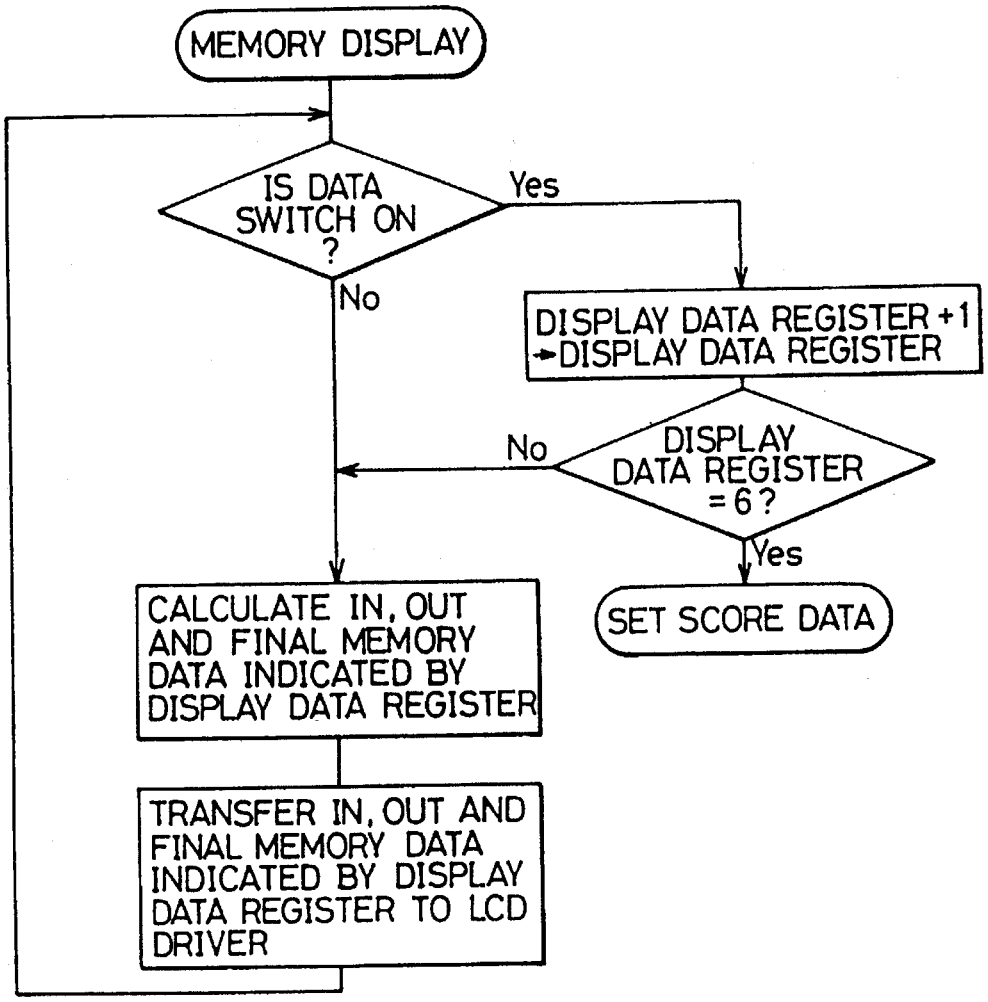
FIG. 6 is a flow chart showing a memory display operation in the embodiment shown in FIG. 3.
Figure 7:
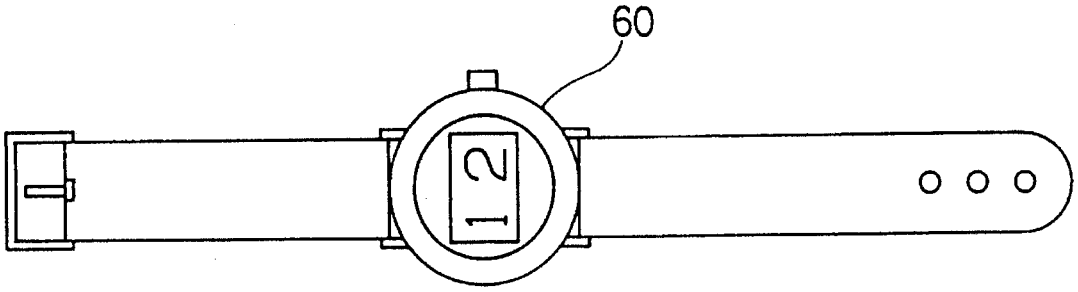
Fig.7 Prior Art
FIG. 7 is a plan view showing a conventional mechanical counter.

When a data output request trigger signal is inputted from the exterior, the data memory serial conversion part 40 outputs the newest score data stored in the data memory part 34, as shown in FIG. 5.

When the data switch 36 is depressed, "1" is added to a display register of the display 31 so that the total data of the out course, the in course and the overall round displayed on the display data register of the data memory 34 are calculated and transferred to the LCD driver 27*b* to be displayed.

Assuming that five regions are prepared in the data memory 34, this data memory 34 is returned to setting of score data (current data) when the display register reaches "6". If the fifth data memory of the data memory part 34 is not employed, the data memory part 34 is returned to setting of the score data when "1" is added to the maximum data memory number as employed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf score display device, comprising:

a counter switch for being depressed every stroke for inputting a stroke number;

a hole switch for being depressed every hole;

a counter part connected to said counter switch, said counter part comprising eighteen first counters corresponding to respective holes for one round, two second counters corresponding to first and second halves of said round, respectively, and a third counter corresponding to a total score for the entire round;

first switching means for connecting said counter switch to any one of said first counters while successively switching such connection by outputs of said hole switch;

first frequency divider means for receiving said outputs of said hole switch and for generating an output corresponding to a total score for a particular half of said round;

second switching means for connecting said counter switch to either one of said second counters while alternatively switching such connection by outputs of said first frequency divider means; and a display part provided with eighteen digital display elements for said first counters, two digital display elements for said second counters and one digital display element for said third counter, and said digital display elements having display switching functions.

2. A golf score display device in accordance with claim 1, further comprising:

second frequency divider means for receiving outputs of said hole switch and for generating an output at the hole number for said one round;

a data memory part having a plurality of data memories connected in series for storing count values of said counters of said counter part, said data memory part storing said count values of said counters of said counter part in a first stage data memory of said data memories by an output of said second frequency divider means while storing the contents of precedent stage data memories of said data memories in remaining said data memories;

a data switch for switching a display content of said display part; and third switching means for connecting said display part to any one of said data memories of said data memory part while successively switching such connection by an output of said data switch.

3. A golf score display device in accordance with claim 2, further comprising a data memory serial conversion part being connected to said first stage data memory of said data memory part for converting the content of said data memory to serial data and outputting the serial data.

4. A golf score display device in accordance with claim 3, wherein said display part consists of a liquid crystal display element, and said counter part, said first and second switching means, said first and second frequency divider means, said data memory part and said data memory serial conversion part are integrated into a circuit so that overall said display device is packaged in the form of a card.

5. A golf score display device in accordance with claim 1, wherein said counter part, said first and second switching means, said first frequency divider means and said data memory part are formed by a microcomputer system, so that overall said display device is packaged in the form of a card.

6. A golf score display device in accordance with claim 2, wherein said counter part, said first and second switching means, said first and second frequency divider means and said data memory part are formed by a microcomputer system, so that overall said display device is packaged in the form of a card.

7. A golf score display device in accordance with claim 3, wherein said counter part, said first and second switching means, said first and second frequency divider means and said data memory part are formed by a microcomputer system, so that overall said display device is packaged in the form of a card.

8. A golf score display device, comprising:

a counter switch for being depressing every stroke for inputting a stroke number;

a hole switch for being depressed every hole;

a counter part connected to said counter switch, said counter part comprising eighteen first counters corresponding to respective holes for one round, two second counters corresponding to first and second halves of said round, respectively, and a third counter corresponding to a total score for the round;

first switching means for connecting said counter switch to any one of said first counters while successively switching such connection by outputs of said hole switch;

first frequency divider means for receiving said outputs of said hole switch and for generating an output at the hole number for the particular half of said round;

second switching means for connecting said counter switch to either one of said second counters while alternatively switching such connection by outputs of said first frequency divider means;

a display part provided with eighteen digital display elements for said first counters, two digital display elements for said second counters and one digital display element for said third counter, and said digital display elements having display switching functions;

second frequency divider means for receiving outputs of said hole switch and for generating an output at the hole number for said one round;

a data memory part having a plurality of data memories connected in series for storing count values of said counters of said counter part, said data memory part storing said count values of said counters of said counter part in a first stage data memory of said data memories by an output of said second frequency divider means while storing the contents of precedent stage data memories of said data memories in remaining said data memories;

a data switch for switching a display content of said display part; and third switching means for connecting said display part to any one of said data memories of said data memory part while successively switching such connection by an output of said data switch to display one of the data memories from a past round.

9. A golf score display device in accordance with claim 8, wherein said eighteen digital display elements are arranged in two rows and nine columns on a front face of the device.

* * * * *